US006964716B2

(12) United States Patent
Wu

(10) Patent No.: US 6,964,716 B2
(45) Date of Patent: Nov. 15, 2005

(54) GAS GENERATING COMPOSITION

(75) Inventor: Jianzhou Wu, Himeji (JP)

(73) Assignee: Daicel Chemical Industries, Ltd., Osaka (JP)

( * ) Notice: Subject to any disclaimer, the term of this patent is extended or adjusted under 35 U.S.C. 154(b) by 0 days.

(21) Appl. No.: 10/659,267

(22) Filed: Sep. 11, 2003

(65) Prior Publication Data

US 2004/0123925 A1 Jul. 1, 2004

Related U.S. Application Data

(60) Provisional application No. 60/411,053, filed on Sep. 17, 2002, and provisional application No. 60/480,235, filed on Jun. 23, 2003.

(30) Foreign Application Priority Data

Sep. 12, 2002 (JP) ..... 2002-266411
Jun. 17, 2003 (JP) ..... 2003-172349

(51) Int. Cl.[7] ..... C06B 31/00; C06B 31/02
(52) U.S. Cl. ..... 149/45; 149/61
(58) Field of Search ..... 149/45, 61

(56) References Cited

U.S. PATENT DOCUMENTS 4,179,327 A * 12/1979 Seldner ..... 216/101
4,369,079 A 1/1983 Shaw
4,370,181 A 1/1983 Lundstrom et al.
4,909,549 A 3/1990 Poole et al.
5,500,059 A 3/1996 Lund et al.
5,542,999 A 8/1996 Bucerius et al.
5,608,183 A 3/1997 Barnes et al.
5,656,793 A 8/1997 Ochi et al.
5,725,669 A 3/1998 Heckmann
5,780,767 A 7/1998 Matsuda et al.
5,834,679 A 11/1998 Seeger
5,841,065 A 11/1998 Mendenhall
6,039,820 A * 3/2000 Hinshaw et al. ..... 149/45
6,077,372 A 6/2000 Mendenhall et al.
6,096,147 A 8/2000 Taylor et al.
6,132,537 A 10/2000 Zeuner et al.
6,468,369 B1 10/2002 Zhou
6,517,647 B1 * 2/2003 Yamato ..... 149/45
2003/0024618 A1 2/2003 Wu et al.
2003/0051630 A1 3/2003 Katsuda et al.

FOREIGN PATENT DOCUMENTS

DE 4401213 C1 3/1995
EP 0801045 A1 10/1997
EP 1241138 A1 9/2002
FR 2772370 6/1999
JP 2-145422 6/1990
JP 10-72273 A 3/1998
JP 10-87390 4/1998
JP 11-502864 3/1999
JP 11-510779 9/1999
JP 11-343192 12/1999
WO WO 97/04860 2/1997
WO WO 97/12849 A1 4/1997
WO WO 97/16397 5/1997
WO WO 98/04507 A1 2/1998
WO WO 01/23304 A1 4/2001
WO WO 01/56953 A1 8/2001
WO WO 03/016244 A1 2/2003

* cited by examiner

*Primary Examiner*—Aileen Felton
(74) *Attorney, Agent, or Firm*—Birch, Stewart, Kolasch & Birch, LLP

(57) ABSTRACT

Provided is a gas generating composition having a low combustion temperature and having a low produced amount of toxic carbon monoxide, ammonia and nitrogen oxides at the time of combustion. The gas generating composition includes the following components (a), (b) and (c) and optionally the component (d) and/or the component (e): (a) an organic compound as fuel; (b) an oxygen-containing oxidizing agent; (c) aluminum hydroxide; (d) a binder; and (e) an additive selected from metal oxides and metal carbide.

24 Claims, No Drawings

GAS GENERATING COMPOSITION

This Nonprovisional application claims priority under 35 U.S.C. § 119(e) on U.S. Provisional Application Nos. 60/411,053 and 60/480,235 filed on Sep. 17, 2002 and Jun. 23, 2003 and under 35 U.S.C. § 119(a) on Patent Application Nos. 2002-266411 and 2003-172349 filed in Japan on Sep. 12, 2002 and Jun. 17, 2003, the entire contents of which are hereby incorporated by reference.

TECHNICAL FIELD

The present invention relates to a gas generating composition suitable for an airbag restraining system of an automobile or the like, a molded article thereof, and an airbag inflator using them.

BACKGROUND ART

Heretofore, compositions containing sodium azide have been often used as airbag gas generating agents for occupant-protecting devices in automobiles. However, the toxic effects of sodium azide on the human body [LD50 (oral-rat)=27 mg/kg) and hazardous nature thereof at the time of handling have been perceived as problems. As an alternative to such compositions, therefore, gas generating compositions containing various kinds of nitrogen-containing organic compounds have been developed as so-called non-azide gas generating compositions.

U.S. Pat. No. 4,909,549 discloses a composition that includes a hydrogen-containing tetrazole, a triazole compound and an oxygen-containing oxidizing agent. U.S. Pat. No. 4,370,181 discloses a gas generating composition that includes a metal salt of bitetrazole containing no hydrogen and an oxidizing agent containing no oxygen. U.S. Pat. No. 4,369,079 discloses a gas generating composition that includes a metal salt of bitetrazole containing no hydrogen and alkali metal nitrate; alkali metal nitrite; alkaline earth metal nitrate; alkaline earth metal nitrite or a mixture thereof. U.S. Pat. No. 5,542,999 discloses a gas generating agents that includes fuel such as GZT, triaminonitroguanidine (TAGN), nitroguanidine (NG) or NTO; basic copper nitrate; a catalyst for decreasing toxic gas and a coolant. JP-A 10-72273 discloses a gas generating agent that includes a metal salt of bitetrazole; an ammonium salt of bitetrazole; aminotetrazle and ammonium nitrate.

However, although azide-based gas generating agents generate only nitrogen in general after combustion, non-azide-based gas generating compositions have a disadvantage such that small amounts of toxic carbon monoxide and nitrogen oxides are generated because each of the composition contains carbon, nitrogen and oxygen in general. In addition, compared with the azide-based gas generating agents, the non-azide-based gas generating agents have so high combustion temperatures that they may need a large amount of coolant in actual use. For reducing produced amounts of toxic carbon monoxide and nitrogen oxides after combustion, addition of a metal oxide or a DeNOx agent (a nitrogen-oxide reducing agent) to the gas generating agent is known. For example, in the case of the gas generating composition as disclosed in DE Pat No. 4,401,213, a heavy-metal oxide such as $V_2O_5/MoO_3$ is added as a catalyst for reducing the produced amounts of toxic carbon monoxide and nitrogen oxides. However, the heavy-metal oxide is considered to be toxic, and addition of a metal oxide leads to a decrease of efficiency of gas generation from the gas generating agent.

WO 98/04507 discloses reduction of the produced amount of a nitrogen oxide in combustion gas by using a combination of a DeNOx agent such as ammonium sulfate, ammonium carbonate or urea and a gas generating agent. However, use of ammonium sulfate will generate toxic sulfur oxide and then ammonium carbonate and urea have problems in their thermal stability. Furthermore, if the DeNOx agents are added, the oxidizing agent in the gas generating agent will be consumed and a produced amount of toxic carbon monoxide is increased.

DISCLOSURE OF THE INVENTION

A purpose of the present invention is to provide a gas generating composition having small produced amounts of toxic monoxide carbon and nitrogen oxides in combustion gas of a gas generating agent and having a low combustion temperature; a molded article thereof and an airbag inflator using the same.

The inventors of the present invention have completed the present invention by finding out that the produced amounts of toxic carbon monoxide, ammonium and nitrogen oxides in combustion gas can be reduced by selecting a specific combination for a gas generating composition to decrease the combustion temperature.

As means for solving the problem, the present invention provides a gas generating composition comprising the following components (a), (b), and (c) and optionally the component (d) and/or the component (e):

(a) an organic compound as fuel;

(b) an oxygen-containing oxidizing agent;

(c) aluminum hydroxide;

(d) a binder; and (e) an additive selected from metal oxides and metal carbide.

Furthermore, as another means for solving the problem, the present invention provides a molded article of the gas generating composition, which is obtained by molding the gas generating composition described above, and an airbag inflator using the gas generating composition described above or the molded article of a gas generating composition described above.

The gas generating composition and the molded article thereof have low combustion temperatures and small produced amounts of carbon monoxide and nitrogen oxides at the time of combustion.

Embodiment of the Invention

As the organic compound to use for the component (a) of fuel in the present invention, it includes at least one compound selected from tetrazole compounds, guanidine compounds, triazine compounds and nitroamine compounds.

As the tetrazole compounds, 5-aminotetrazole, bitetrazole ammonium salts and the like are preferable. The guanidine compounds preferably are guanidine nitrates, amino guanidine nitrate, nitro guanidine, triamino guanidine nitrate and the like. The triazine compounds are preferably melamine, cyanuric acid, ammeline, ammelide, ammeland and the like. The nitroamine compounds are preferably cyclo-1,3,5-trimethylene-2,4,6-trinitramine.

The oxygen-containing oxidizing agent to use as the component (b) in the present invention preferably includes at least one selected from: (b-1) basic metal nitrates, nitrate salts and ammonium nitrates and (b-2) perchlorates and chlorates.

As the basic metallic nitrates of the component (b-1), at least one selected from basic copper nitrates, basic cobalt nitrates, basic zinc nitrates, basic manganese nitrates, basic iron nitrates, basic molybdenum nitrates, basic bismuth nitrates and basic cerium nitrates can be included.

For increasing the burning velocity, the basic metal nitrate has preferably an average particle size of 30 $\mu$m or less, more preferably of 10 $\mu$m or less. Furthermore, the average particle sizes were measured by a particle size distribution method with scattered laser beams. A measured sample is prepared by dispersing a basic metal nitrate in water and exposing it to ultrasonic waves for 3 minutes. A 50%-accumulated value (D50) of the number of particles is determined and an average value of two measurements is taken as an average particle size.

As the nitrates of the component (b-1), alkali metal nitrates such as potassium nitrate or sodium nitrate and alkaline earth metal nitrates such as strontium nitrate can be included.

The perchlorates and chlorates of the component (b-2) are that having a combustion promotion action as well as an oxidative action. The oxidative action means a function to proceed combustion efficiently with oxygen generated during burning and then another function to decrease the produced amount of toxic gas such as ammonia or carbon monoxide. The combustion promotion action, on the other hand, means a function to improve ignition of a gas generating composition and to increase a burning velocity.

As the perchlorates and chlorates, at least one selected from ammonium perchlorate, potassium perchlorate, sodium perchlorate, potassium chlorate and sodium chlorate can be included.

The aluminum hydroxide to use as the component (c) in the present invention is one used for condensing floating matters in river water for water-purifying procedures of public water supply, for a household non-phosphorus detergent and also as an additive to resin or rubber, having characteristics of a low toxicity and a high decomposition-initiating temperature.

Furthermore, it absorbs a large amount of heat when thermally decomposed to generate aluminum oxide and water. Therefore, the combustion temperature of the gas generating composition is lowered by incorporating aluminum hydroxide so that the composition will act to reduce the produced amounts of toxic nitrogen oxide and carbon monoxide after the combustion. Such reduction of the toxic gas is quite remarkable when the component (b-2) is used as the oxidizing agent.

The overall dispersibility of the mixed components (a) to (c) can be improved by adjusting the average particle size of aluminum hydroxide. Therefore the mixing operation is made easier and then ignition of the obtained gas generating composition is improved.

The average particle size of aluminum hydroxide is preferably 0.1 to 70 $\mu$m, more preferably 0.5 to 50 $\mu$m, still more preferably 2 to 30 $\mu$m. The method for measuring the average particle size of the aluminum hydroxide is the same as one used for measuring the average particle size of the basic metal nitrate.

The binder to use as the component (d) in the present invention may be a component to use optionally in combination with the components (a) to (c) or with the components (a) to (c) and the component (e). It is capable of increasing moldability of the gas generating composition and also increasing strength of the molded article of a gas generating composition. When the molding strength of the molded article of a gas generating composition is not high, there is a possibility that the molded article will be broken at actual combustion and burn too rapidly, not being able to control.

As the binder, at least one selected from carboxymethylcellulose, sodium carboxymethylcellulose, potassium carboxymethylcellulose, ammonium carboxymethylcellulose, cellulose acetate, cellulose acetate butyrate, methylcellulose, ethylcellulose, hydroxyethylcellulose, ethylhydroxyethylcellulose, hydroxypropylcellulose, carboxymethylethylcellulose, micro-crystalline cellulose, polyacrylamide, an aminated product of polyacrylamide, polyacrylhydrazide, a copolymer of acrylamide and a metal acrylate, a copolymer of polyacrylamide and a polyacrylic ester, polyvinyl alcohol, acrylic rubber, guar gum, starch and silicone can be included.

The additive, selected from metal oxides and metal carbides, to use as the component (e) in the present invention, is a component to use optionally in combination with the components (a) to (c) or with the components (a) to (c) and the component (d) and is added for assisting the action of aluminum hydroxide, that is, for decreasing the combustion temperature of the gas generating agent, adjusting the burning velocity thereof and reducing the produced amount of toxic nitrogen oxide and carbon monoxide after combustion.

As the additives, at least one selected from metal oxides such as copper oxide, iron oxide, zinc oxide, cobalt oxide, manganese oxide, molybdenum oxide, nickel oxide, bismuth oxide, silica or alumina; metal carbonates or basic metal carbonates such as cobalt carbonate, calcium carbonate, basic zinc carbonate or basic copper carbonate; composite compounds of metal oxides or metal hydroxides such as acid clay, porcelain clay (Kaolin), talc, bentonite, diatomaceus earth or hydrotalcite; metal acid salts such as sodium silicate, mica molybdate, cobalt molybdate or ammonium molybdate; molybdenum disulfide; calcium stearate; silicon nitride or silicon carbide can be included.

The contents of the respective components included in the gas generating composition of the present invention and also exemplified compositions thereof are described below.

(1) A Composition Containing the Components (a) to (c)

The content of the organic compound provided as the component (a) is preferably 10 to 60% by mass, more preferably 5 to 60% by mass, still more preferably 10 to 55% by mass;

The content of the oxidizing agent provided as the component (b-1) is preferably 10 to 85% by mass, more preferably 20 to 70% by mass, still more preferably 30 to 60% by mass;

The content of the oxidizing agent provided as the component (b-2) is preferably 0.5 to 20% by mass, more preferably 1 to 10% by mass, still more preferably 1 to 5% by mass;

The content of the aluminum hydroxide provided as the component (c) is preferably 0.1 to 20% by mass, more preferably 3 to 15% by mass, still more preferably 4 to 10% by mass.

Composition Example 1

(a) guanidine nitrate 30–60 mass %
(b) basic copper nitrate 30–60 mass %
(c) aluminum hydroxide 3–10 mass %

Composition Example 2

(a) nitroguanidine 25–60 mass %
(b) basic copper nitrate 30–60 mass %
(c) aluminum hydroxide 3–15 mass %

Composition Example 3

(a) guanidine nitrate or melamine
(b-1) basic copper nitrate
(b-2) at least one perchlorate selected from sodium perchlorate, potassium perchlorate and ammonium perchlorate
(C) aluminium hydroxide Composition Example 4

(a) guanidine nitrate or melamine
(b-1) basic copper nitrate
(b-2) sodium chlorate or potassium chlorate
(c) aluminium hydroxide (3) A Composition Containing Either One or Both of the Components (d) and (e) in Addition to the Compositions (a) to (c).

The content of the component (d) is preferably 20% by mass or less, more preferably 0.5 to 10% by mass, still more preferably 1 to 7% by mass;

The content of the component (e) is preferably 20% by mass or less, more preferably 1 to 15% by mass, still more preferably 3 to 10% by mass.

Composition Example 5

(a) nitroguanidine
(b) strontium nitrate
(c) aluminium hydroxide
(d) sodium carboxymethylcellulose or guar gum Composition Example 6

(a) nitroguanidine
(b) basic copper nitrate
(c) aluminium hydroxide
(d) guar gum Composition Example 7

(a) melamine
(b) basic copper nitrate
(c) aluminium hydroxide
(d) sodium carboxymethylcellulose or guar gum Composition Example 8

(a) guanidine nitrate
(b) basic copper nitrate
(c) aluminium hydroxide
(d) sodium carboxymethylcellulose or guar gum Composition Example 9

(a) a mixed fuel of 2 or 3 components selected from guanidine nitrate, nitroguanidine and melamine
(b) basic copper nitrate
(c) aluminium hydroxide
(d) sodium carboxymethylcellulose or guar gum Composition Example 10

(a) guanidine nitrate or melamine
(b-1) basic copper nitrate
(b-2) at least one perchlorate selected from sodium perchlorate, potassium perchlorate and ammonium perchlorate
(c) aluminium hydroxide
(d) sodium carboxymethylcellulose or guar gum Composition Example 11

(a) guanidine nitrate or melamine
(b-1) basic copper nitrate
(b-2) sodium chlorate or potassium perchlorate
(a) aluminium hydroxide
(d) sodium carboxymethylcellulose or guar gum The gas generating composition of the present invention can be molded in a desired shape, for example a molded article in the shape of a single-perforated cylinder, a porous cylinder or a pellet.

The molded article can be manufactured by adding and mixing water or an organic solvent with a gas generating composition and subjecting the resultant mixture to an extrusion molding (a single-perforated or porous cylindrical-shaped molded article) or by subjecting the mixture to a compression molding with a tablet machine or the like (a pellet-shaped molded article). The single-perforated or porous cylindrical-shaped molded article may be either one having a through-hole in the long direction or one having no through-hole but a recess.

The gas generating composition of the present invention and the molded article obtained therefrom can be applied to, for example, an airbag inflator for a driver seat, an airbag inflator for a passenger seat, a side-airbag inflator, an inflatable curtain inflator, a knee-bolster inflator, an inflatable seatbelt inflator, a tubular system inflator and a pretensioner gas generator in each of various kinds of vehicles.

The inflator using the gas generating composition of the present invention or the molded article obtained therefrom may be either of a pyro type in which gas is supplied only from the gas generating agent or a hybrid type in which the gas is supplied from both compression gas such as argon and the gas generating agent.

Furthermore, the gas generating composition of the present invention or the molded article obtained therefrom may be used as an igniting agent referred to as an enhancer agent (or a booster) for transferring energy from a percussion cap or a squib to the gas generating agent.

EXAMPLES

Hereinafter, the present invention will be described in more detail with reference to examples. However, the present invention is not limited to these examples.

Examples 1 to 27 and Comparative Examples 1 to 7

Gas generating compositions having compositions shown in Table 1 were prepared. A combustion temperature and a gas-generating efficiency (unit: mol/100 g represents the number of moles of the generated gas per 100 g of the composition gas) were obtained on these compositions, based on theoretical calculation. The results are shown in Table 1.

TABLE 1

| | composition (ratio: mass %) | burning velocity (k) | gas yield (mol/100 g) |
|---|---|---|---|
| Com. Ex. 1 | NQ/$Sr(NO_3)_2$ (56.9/43.1) | 2647 | 2.96 |
| Ex. 1 | NQ/$Sr(NO_3)_2$/$Al(OH)_3$ (54.1/40.9/5) | 2502 | 2.90 |
| Ex. 2 | NQ/$Sr(NO_3)_2$/$Al(OH)_3$ (51.3/38.7/10) | 2341 | 2.84 |
| Ex. 3 | NQ/$Sr(NO_3)_2$/$Al(OH)_3$ (48.6/36.4/15) | 2279 | 2.80 |
| Com. Ex. 2 | NQ/BCN (51.3/48.7) | 2270 | 2.87 |
| Ex. 4 | NQ/BCN/$Al(OH)_3$ (48.8/46.2/5) | 2131 | 2.83 |
| Ex. 5 | NQ/BCN/$Al(OH)_3$ (46.4/43.6/10) | 1991 | 2.78 |
| Ex. 6 | NQ/BCN/$Al(OH)_3$ (43.9/41.1/15) | 1852 | 2.74 |
| Com. Ex. 3 | GN/BCN (53.4/46.6) | 1911 | 3.01 |
| Ex. 7 | GN/BCN/$Al(OH)_3$ (52.8/42.2/5) | 1619 | 3.04 |
| Ex. 8 | GN/BCN/$Al(OH)_3$ (50.2/39.8/10) | 1527 | 2.99 |
| Ex. 9 | GN/BCN/$Al(OH)_3$ (47.5/37.5/15) | 1419 | 2.94 |
| Com. Ex. 4 | melamine/BCN (20.8/79.2) | 1503 | 2.14 |
| Ex. 10 | melamine/BCN/$Al(OH)_3$ (20.6/74.4/5) | 1358 | 2.19 |
| Ex. 11 | melamine/BCN/$Al(OH)_3$ (19.5/70.5/10) | 1282 | 2.17 |
| Ex. 12 | melamine/BCN/$Al(OH)_3$ (18.5/66.5/15) | 1164 | 2.16 |
| Com. Ex. 5 | NQ/$Sr(NO_3)_2$/CMCNa (38.4/52.2/9.4) | 2494 | 2.65 |
| Ex. 13 | NQ/$Sr(NO_3)_2$/$Al(OH)_3$/CMCNa (35.7/49.9/5/9.4) | 2328 | 2.60 |
| Ex. 14 | NQ/$Sr(NO_3)_2$/$Al(OH)_3$/CMCNa (32.9/47.7/10/9.4) | 2252 | 2.55 |
| Ex. 15 | NQ/$Sr(NO_3)_2$/$Al(OH)_3$/CMCNa (30.2/45.4/15/9.4) | 2104 | 2.49 |
| Com. Ex. 6 | NQ/BCN/guar gum (39.4/55.6/5) | 2097 | 2.68 |
| Ex. 16 | NQ/BCN/$Al(OH)_3$/ guar gum (37.0/53.0/5/5) | 1950 | 2.64 |
| Ex. 17 | NQ/BCN/$Al(OH)_3$/ guar gum (34.5/50.5/10/5) | 1806 | 2.6 |
| Ex. 18 | NQ/BCN/$Al(OH)_3$/ guar gum (32.0/48.0/15/5) | 1663 | 2.55 |
| Com. Ex. 7 | GN/BCN/ guar gum (42.7/52.3/5) | 1678 | 2.86 |
| Ex. 19 | GN/BCN/$Al(OH)_3$/ guar gum (40.0/50.0/5/5) | 1564 | 2.80 |
| Ex. 20 | GN/BCN/$Al(OH)_3$/ guar gum (37.3/47.7/10/5) | 1451 | 2.75 |
| Ex. 21 | GN/BCN/$Al(OH)_3$/ guar gum (34.7/45.3/15/5) | 1358 | 2.70 |
| Ex. 22 | melamine/BCN/$Al(OH)_3$/CMCNa (17.8/74.2/5/3) | 1358 | 2.15 |
| Ex. 23 | melamine/BCN/$Al(OH)_3$/CMCNa (16.7/70.3/10/3) | 1292 | 2.14 |
| Ex. 24 | melamine/BCN/$Al(OH)_3$/CMCNa (15.7/66.3/15/3) | 1177 | 2.13 |

TABLE 1-continued

| | composition (ratio: mass %) | burning velocity (k) | gas yield (mol/100 g) |
|---|---|---|---|
| Ex. 25 | melamine/BCN/$Al(OH)_3$/guar gum (17.5/74.5/5/3) | 1358 | 2.16 |
| Ex. 26 | melamine/BCN/$Al(OH)_3$/guar gum (16.4/70.6/10/3) | 1281 | 2.15 |
| Ex. 27 | melamine/BCN/$Al(OH)_3$/guar gum (15.4/66.6/15/3) | 1166 | 2.14 |

In Table 1, GN is guanidinenitrate, NQ is nitroguanidine, BCN is basic copper nitrate and CMCNa is sodium carboxymethylcellulose. The other tables are also shown in the same manner. The average particle size of basic copper nitrate of Table 1 is 4.7 $\mu$m (applied to the other tables) and the average particle size of aluminum hydroxide is 11 $\mu$m (applied to the other tables).

The combustion temperatures of the compositions of Examples 1 to 27, including added aluminum hydroxide, are lower than those of the corresponding Comparative Examples 1 to 7 containing no aluminum hydroxide.

Examples 28 to 33

Gas generating compositions having compositions shown in Table 2 were prepared. These compositions were tested by an explosive performance examination method of JIS K4810-1979 in term of friction sensitivity and drop hammer sensitivity. Results are shown in Table 2.

TABLE 2

| | composition (ratio: mass %) | friction sensitivity (N) | drop hammer sensitivity (cm) |
|---|---|---|---|
| Ex. 28 | NQ/$Sr(NO_3)_2$/$Al(OH)_3$ (51.3/38.7/10) | >353 | 60~70 |
| Ex. 29 | NQ/$Sr(NO_3)_2$/$Al(OH)_3$/CMCNa (32.9/47.7/10/9.4) | >353 | 60~70 |
| Ex. 30 | メラミン/BCN/$Al(OH)_3$/ CMCNa (16.7/70.3/10/3) | >353 | >100 |
| Ex. 31 | GN/BCN/$Al(OH)_3$/ guar gum (40.0/50.0/5/5) | >353 | 40~50 |
| Ex. 32 | GN/BCN/$Al(OH)_3$/ CMCNa (41.3/48.7/5/5) | >353 | 40~50 |
| Ex. 33 | NQ/BCN/$Al(OH)_3$/guar gum (34.5/50.5/10/5) | >353 | 50~60 |

In Examples 28 to 33, the friction sensitivities are higher than 353 N and the drop hammer sensitivities are 40 cm or more. Therefore, the friction drop hammer sensitivities are so insufficient that a good safety can be attained at the time of handling.

Examples 34 to 44

Gas generating compositions having compositions shown in Table 3 were prepared. These compositions were molded in the shape of strand and were subjected to the measurements of burning velocity at a pressure of 4,900, 6,860 or 8,820 kPa in nitrogen atmosphere. Burning velocity at 6,860 kPa and pressure index between 4,900 and 8,820 kPa are shown in Table 3. The pressure index was calculated from the following equation: $rb=\alpha Pn$ (wherein rb: burning velocity, $\alpha$: coefficient, P: pressure, and n: pressure index).

TABLE 3

| | composition (ratio: mass %) | burning velocity (mm/sec) | pressure index |
|---|---|---|---|
| Ex. 34 | NQ/$Sr(NO_3)_2$/$Al(OH)_3$/CMCNa (35.3/50.3/5.0/9.4) | 11.20 | 0.52 |
| Ex. 35 | NQ/$Sr(NO_3)_2$/$Al(OH)_3$/CMCNa (34.2/49.4/7.0/9.4) | 10.35 | 0.62 |
| Ex. 36 | NQ/$Sr(NO_3)_2$/$Al(OH)_3$/CMCNa (33.1/48.5/9.0/9.4) | 9.47 | 0.58 |
| Ex. 37 | NQ/BCN/$Al(OH)_3$/guar gum (37.0/53.0/5.0/5.0) | 13.75 | 0.19 |
| Ex. 38 | NQ/BCN/$Al(OH)_3$/guar gum (34.5/50.5/10.0/5.0) | 12.87 | 0.24 |
| Ex. 39 | NQ/BCN/$Al(OH)_3$/guar gum (32.2/55.8/5.0/7.0) | 13.74 | 0.30 |
| Ex. 40 | NQ/BCN/$Al(OH)_3$/guar gum (29.8/53.2/10.0/5.0) | 11.28 | 0.33 |
| Ex. 41 | GN/BCN/$Al(OH)_3$/CMCNa (41.3/48.7/5.0/5.0) | 7.32 | 0.22 |
| Ex. 42 | GN/BCN/$Al(OH)_3$/guar gum (40.0/50.0/5.0/5.0) | 7.33 | 0.27 |
| Ex. 43 | melamine/BCN/$Al(OH)_3$/guar gum (17.5/74.5/5/3) | 13.98 | 0.18 |
| Ex. 44 | melamine/BCN/$Al(OH)_3$/guar gum (16.4/70.6/3/10) | 10.15 | 0.20 |

As described above, each of the numeric values represented in Examples 34 to 44 shows that practical conditions for the inflator gas generating compositions are satisfied.

Examples 45 to 53

Gas generating compositions having compositions shown in Table 4 were prepared. These compositions were molded in the shape of 2 g of strand. Each of the strands was displaced in a closed gas bombé of one litter. Nitrogen gas was purged therein. The pressure was elevated up to 6,860 Pa with nitrogen and the strand was ignited by passage of an electric current through a nichrome wire to burn the strand completely. After approximately 20 seconds from the electrification, the combustion gas was sampled into a gas-sampling bag and was immediately analyzed in terms of concentrations of NO, $NO_2$, CO and $CO_2$.

TABLE 4

| | composition (ratio: mass %) | yield of NO (ppm) | yield of $NO_2$ (ppm) | yield of CO (ppm) | yield of $CO_2$ (ppm) |
|---|---|---|---|---|---|
| Ex. 45 | NQ/$Sr(NO_3)_2$/$Al(OH)_3$/CMCNa (36.4/51.2/3/9.4) | 23 | 0 | 420 | 2800 |
| Ex. 46 | NQ/$Sr(NO_3)_2$/$Al(OH)_3$/CMCNa (33.1/48.5/9/9.4) | 32 | 0 | 350 | 2600 |
| Ex. 47 | NQ/$Sr(NO_3)_2$/$Al(OH)_3$/CMCNa (31.7/51.9/7/9.4) | 45 | 0 | 70 | 2600 |
| Ex. 48 | NQ/$Sr(NO_3)_2$/$Al(OH)_3$/CMCNa (33.7/49.9/7/9.4) | 35 | 0 | 280 | 2800 |
| Ex. 49 | melamine/BCN/$Al(OH)_3$/CMCNa (17.8/74.2/5/3) | 8 | 0 | 100 | 1700 |
| Ex. 50 | melamine/BCN/$Al(OH)_3$/CMCNa (15.7/71.3/10/3) | 13 | 0 | 70 | 1900 |
| Ex. 51 | melamine/BCN/$Al(OH)_3$/CMCNa (16.7/70.3/10/3 ) | 6 | 0 | 130 | 2100 |
| Ex. 52 | melamine/BCN/$Al(OH)_3$/CMCNa (17.7/69.3/10/3 ) | 4 | 0 | 160 | 1700 |
| Ex. 53 | melamine/BCN/$Al(OH)_3$/CMCNa (15.7/66.3/15/3 ) | 5 | 0 | 100 | 1700 |

ppm is based on weight

Examples 54 to 70 and Comparative Examples 8 to 10

Gas generating compositions having compositions shown in Table 5 were prepared. A combustion temperature based on theoretical calculation and a gas yield (the unit of mol/100 g represents the number of moles of the generated gas per 100 g of the composition) were obtained about the compositions. Results are shown in Table 5.

TABLE 5

| | composition (ratio: mass %) | burning velocity (k) | gas yield (mol/100 g) |
|---|---|---|---|
| Com. Ex. 8 | NQ/$Sr(NO_3)_2$ (56.9/43.1) | 2647 | 2.96 |
| Com. Ex. 9 | GN/BCN (53.4/46.6) | 1911 | 3.01 |
| Ex. 54 | GN/BCN/$Al(OH)_3$/$NH_4ClO_4$ (50.0/35.0/10/5) | 1770 | 3.07 |
| Ex. 55 | GN/BCN/$Al(OH)_3$/$KClO_4$ (51.09/33.91/10/5) | 1756 | 3.02 |
| Ex. 56 | GN/BCN/$Al(OH)_3$/$NaClO_4$ (51.63/33.37/10/5) | 1749 | 3.14 |
| Ex. 57 | GN/BCN/$Al(OH)_3$/$NaClO_3$ (50.99/34.01/10/5) | 1756 | 3.01 |
| Ex. 58 | GN/BCN/$Al(OH)_3$/$KClO_3$ (50.46/34.54/10/5) | 1735 | 2.99 |
| Ex. 59 | GN/BCN/$Al(OH)_3$/$NH_4ClO_4$/CMCNa (38.4/41.6/10/5/5) | 1694 | 2.85 |
| Ex. 60 | GN/BCN/$Al(OH)_3$/$KClO_4$/CMCNa (39.48/40.52/10/5/5) | 1680 | 2.78 |
| Ex. 61 | GN/BCN/$Al(OH)_3$/$NaClO_4$/CMCNa (39.03/43.47/10/2.5/5) | 1645 | 2.77 |
| Ex. 62 | GN/BCN/$Al(OH)_3$/$NaClO_4$/CMCNa (40.03/39.97/10/5/5) | 1714 | 2.80 |
| Ex. 63 | GN/BCN/$Al(OH)_3$/$NaClO_4$/CMCNa (41.02/36.48/10/7.5/5) | 1778 | 2.83 |
| Ex. 64 | GN/BCN/$Al(OH)_3$/$NaClO_3$/CMCNa (38.86/41.14/10/5/5) | 1695 | 2.77 |
| Ex. 65 | GN/BCN/$Al(OH)_3$/$KClO_3$/CMCNa (39.39/40.16/10/5/5) | 1665 | 2.75 |
| Com. Ex. 10 | Melamine/BCN (20.8/79.2) | 1503 | 2.14 |
| Ex. 66 | melamine/BCN/$Al(OH)_3$/$KClO_4$/CMCNa (14.96/65.04/10/5/5) | 1398 | 2.20 |
| Ex. 67 | melamine/BCN/$Al(OH)_3$/$NH_4ClO_4$/ | 1387 | 2.11 |

TABLE 5-continued

| | composition (ratio: mass %) | burning velocity (k) | gas yield (mol/100 g) |
|---|---|---|---|
| | CMCNa (15.38/64.62/10/5/5) | | |
| Ex. 68 | melamine/BCN/$Al(OH)_3$/$NaClO_4$/ CMCNa (15.59/64.41/10/5/5) | 1415 | 2.13 |
| Ex. 69 | melamine/BCN/$Al(OH)_3$/$NaClO_3$/ CMCNa (15.34/64.66/10/5/5) | 1370 | 2.10 |
| Ex. 70 | melamine/BCN/$Al(OH)_3$/$KClO_3$/ CMCNa (15.14/64.86/10/5/5) | 1394 | 2.11 |

The combustion temperatures of the compositions, with added aluminum hydroxide, of Examples 54 to 70 are lower than those of Comparative Examples 8 to 10 containing no aluminum hydroxide.

Examples 71 to 79

Gas generating compositions having compositions shown in Table 6 were prepared. These compositions were tested by an explosive performance examination method of JIS K4810-1979 in terms of friction sensitivity and drop hammer sensitivity. Results are shown in Table 6.

TABLE 6

| | composition (ratio: mass %) | friction sensitivity (N) | drop hammer sensitivity (cm) |
|---|---|---|---|
| Ex. 71 | GN/BCN/$Al(OH)_3$/$NH_4ClO_4$ (50.0/35.0/10/5) | >353 | >60 |
| Ex. 72 | GN/BCN/$Al(OH)_3$/$NH_4ClO_4$/CMCNa (38.40/41.60/10/5/5) | >353 | >60 |
| Ex. 73 | GN/BCN/$Al(OH)_3$/$KClO_4$/CMCNa (39.48/40.52/10/5/5) | >353 | >60 |
| Ex. 74 | GN/BCN/$Al(OH)_3$/$NaClO_4$/CMCNa (40.03/39.97/10/5/5) | >353 | >60 |
| Ex. 75 | GN/BCN/$Al(OH)_3$/$NaClO_4$/CMCNa (41.02/36.48/10/7.5/5) | >353 | >60 |
| Ex. 76 | GN/BCN/$Al(OH)_3$/$NaClO_3$/CMCNa (38.86/41.14/10/5/5) | >353 | >60 |
| Ex. 77 | GN/BCN/$Al(OH)_3$/$KClO_3$/CMCNa (39.39/40.16/10/5/5) | >353 | 50–60 |
| Ex. 78 | melamine/BCN/$Al(OH)_3$/$NH_4ClO_4$/ CMCNa (15.38/64.62/10/5/5) | >353 | >60 |
| Ex. 79 | melamine/BCN/$Al(OH)_3$/$NaClO_4$/ CMCNa (15.59/64.41/10/5/5) | >353 | >60 |

In Examples 71 to 79, the friction sensitivities are higher than 353 N and the drop hammer sensitivities are 50 cm or more. Therefore, the friction drop hammer sensitivities are so insufficient that a high safety can be attained at the time of handling.

Examples 80 to 84

Gas generating compositions having compositions shown in Table 7 were prepared. The compositions were molded in the shape of strand and subjected to measurements of burning velocity at pressure of 4,900, 6,860 or 8,820 kPa in a nitrogen atmosphere. Burning velocity at 6,860 kPa and pressure index between 4,900 and 8,820 kPa were shown in Table 7. The pressure index was calculated from the following equation: $rb=\alpha Pn$ (wherein rb: burning velocity, $\alpha$: coefficient, P: pressure, and n: pressure index).

TABLE 7

| | composition (ratio: mass %) | burning velocity (mm/sec) | pressure index |
|---|---|---|---|
| Ex. 80 | GN/BCN/$Al(OH)_3$/$KClO_4$/CMCNa (39.48/40.52/10/5/5) | 7.78 | 0.30 |
| Ex. 81 | GN/BCN/$Al(OH)_3$/$NH_4ClO_4$/CMCNa (38.40/41.60/10/5/5) | 7.86 | 0.40 |
| Ex. 82 | GN/BCN/$Al(OH)_3$/$NaClO_4$/CMCNa (40.03/39.97/10/5/5) | 8.12 | 0.28 |
| Ex. 83 | GN/BCN/$Al(OH)_3$/$KClO_3$/CMCNa (38.86/41.14/10/5/5) | 7.56 | 0.27 |
| Ex. 84 | GN/BCN/$Al(OH)_3$/$NaClO_3$/CMCNa (39.39/40.16/10/5/5) | 9.16 | 0.30 |

As described above, each of the numeric values represented in Examples 80 to 84 shows that practical conditions for the inflator gas generating compositions are satisfied. In addition, the burning velocity was increased by containing the component (d), compared with the burning velocity (7.32 mm/sec.) of Example 41 (GN/BCN/$Al(OH)_3$/CMCNa) in Table 3 containing no component (d).

The increase in burning velocity allows more selected methods of manufacturing the gas generating agent. For instance, the molded article of a gas generating composition is required to be thin so that the gas generating agent is completely combusted within a predetermined time when the burning velocity is small. Molding into pellets by a compression molding or the like, on the other hand, is involved in difficulty in tabletting too thin pellets. A large burning velocity will solve such a problem in molding.

Examples 85 to 89

Gas generating compositions having compositions shown in Table 8 were prepared. The compositions were molded into 2 g of strand. Each of the strands was displaced in a closed gas bombé of one litter. Nitrogen gas was purged therein. The pressure was elevated up to 6,860 Pa with nitrogen and the strand was ignited by passage of an electric current through a nichrome wire to burn the strand completely. After approximately 20 seconds from the electrification, the combustion gas was sampled into a gas-sampling bag and was immediately analyzed in terms of concentrations of NO, $NO_2$, $NH_3$, CO, and $CO_2$. Results are shown in Table 8.

TABLE 8

| | composition (ratio: mass %) | yield of NO (ppm) | yield of $NO_2$ (ppm) | yield of $NH_3$ (ppm) | yield of CO (ppm) | yield of $CO_2$ (ppm) |
|---|---|---|---|---|---|---|
| Ex. 85 | GN/BCN/$Al(OH)_3$/$KClO_4$/CMCNa (39.48/40.52/10/5/5) | 7.5 | 0 | 7.5 | 220 | 3400 |
| Ex. 86 | GN/BCN/$Al(OH)_3$/$NH_4ClO_4$/CMCNa (38.40/41.60/10/5/5) | 15 | 0 | 0 | 270 | 3500 |
| Ex. 87 | GN/BCN/$Al(OH)_3$/$NaClO_4$/CMCNa (40.03/39.97/10/5/5) | 12 | 0 | 7 | 220 | 3500 |
| Ex. 88 | GN/BCN/$Al(OH)_3$/$KClO_3$/CMCNa (38.86/41.14/10/5/5) | 19 | 0 | 17 | 290 | 3250 |
| Ex. 89 | GN/BCN/$Al(OH)_3$/$NaClO_3$/CMCNa (39.39/40.16/10/5/5) | 13 | 0 | 7 | 215 | 3100 |

ppm is based on mass

I claim:

1. A gas generating composition comprising the following components (a), (b), and (c) and optionally the component (d) and/or the component (e):

(a) 10 to 60% by mass of an organic compound as fuel, (b) 10 to 85% by mass of an oxygen-containing oxidizing agent, (c) 0.1 to 20% by mass of aluminum hydroxide having an average particle size of 2 to 30 $\mu$m, (d) a binder, (e) an additive selected from metal oxides and metal carbides.

2. The gas generating composition as set forth in claim 1, comprising 20% by mass or less of the component (d) and 20% by mass or less of the component (e).

3. The gas generating composition as set forth in claim 1 or 2, wherein the organic compound (a) used as fuel is at least one selected from the group consisting of tetrazole compounds, guanidine compounds, triazine compounds and nitroamine compounds.

4. The gas generating composition as set forth in claim 1 or 2, wherein the basic metal nitrate (b) is at least one selected from the group consisting of a basic copper nitrate, a basic cobalt nitrate, a basic zinc nitrate, a basic manganese nitrate, a basic iron nitrate, a basic molybdenum nitrate, a basic bismuth nitrate and a basic cerium nitrate.

5. The gas generating composition as set forth in claim 1 or 2, comprising, as the component (b), at least one oxidizing agent selected from the group consisting of (b-1) basic metal nitrates, nitrates and ammonium nitrate and (b-2) perchlorates and chlorates.

6. The gas generating composition as set forth in claim 5, wherein the perchlorate and chlorate (b-2) is at least one selected from the group consisting of ammonium perchlorate, potassium perchlorate, sodium perchlorate, potassium chlorate and sodium chlorate.

7. The gas generating composition as set forth in claim 1 or 2, wherein the binder of the component (d) is at least one selected from the group consisting of carboxymethylcellulose, sodium carboxymethylcellulose, potassium carboxymethylcellulose, ammonium carboxymethylcellulose, cellulose acetate, cellulose acetate butyrate, methylcellulose, ethylcellulose, hydroxyethylcellulose, ethylhydroxyethylcellulose, hydroxypropylcellulose, carboxymethylethylcellulose, micro-crystalline cellulose, polyacrylamide, aminated products of polyacrylamide, polyacrylhydrazide, a copolymer of acrylamide and a metal salt acrylate, a copolymer of polyacrylamide and a polyacrylic ester, polyvinyl alcohol, acrylic rubber, guar gum, starch and silicone.

8. The gas generating composition as set forth in claim 1 or 2, wherein the additive of the component (e) is at least one selected from the group consisting of metal oxides including copper (II) oxide, iron oxide, zinc oxide, cobalt oxide, manganese oxide, molybdenum oxide, nickel oxide, bismuth oxide, silica or alumina; metal hydroxides including cobalt hydroxide or iron hydroxides; metallic carbonate or basic metallic carbonate including cobalt carbonate, calcium carbonate, basic zinc carbonates or basic copper carbonates; composite compounds of metal oxides or hydroxides including acid clay, kaolin, talc, bentonite, diatomaceous earth, or hydrotalcite; metallic acid salts including sodium silicate, mica molybdate, cobalt molybdate or ammonium molybdate; silicone; molybdenum disulfide; calcium stearate; silicon nitride and silicon carbide.

9. A molded article of a gas generating composition having a single-perforated cylindrical shape, a porous cylindrical shape or a pellet shape, the molded article being obtained from the gas generating composition as set forth in claim 1 or 2.

10. An airbag inflator, comprising:

the gas generating composition as set forth in claim 1.

11. An airbag inflator, comprising:

the molded article of a gas generating composition as set forth in claim 9.

12. The gas generating composition of claim 1, comprising 3 to 15% by mass of aluminum hydroxide having an average particle size of 2 to 30 $\mu$m.

13. The gas generating composition of claim 1, comprising 4 to 10% by mass of aluminum hydroxide having an average particle size of 2 to 30 $\mu$m.

14. A gas generating composition consisting essentially of the following components (a), (b), and (c) and optionally the component (d):

(a) 10 to 60% by mass of an organic compound as fuel selected from the group consisting of nitroguanidine, guanidine nitrate, and melamine, (b) 10 to 85% by mass of an oxygen-containing oxidizing agent selected from the group consisting of basic copper nitrate, strontium nitrate, ammonium perchlorate, potassium perchlorate, sodium perchlorate, sodium chlorate, and potassium chlorate, (c) 0.1 to 20% by mass of aluminum hydroxide having an average particle size of 2 to 30 μm, (d) 20% by mass or less of a binder selected from the group consisting of sodium carboxymethylcellulose and guar gum.

15. The gas generating composition of claim 14, consisting essentially of nitroguanidine, strontium nitrate, and aluminum hydroxide having an average particle size of 11 μm.

16. The gas generating composition of claim 14, consisting essentially of nitroguanidine, strontium nitrate, aluminum hydroxide having an average particle size of 11 μm, and sodium carboxymethylcellulose.

17. The gas generating composition of claim 14, consisting essentially of nitroguanidine, basic copper nitrate, aluminum hydroxide having an average particle size of 11 μm, sodium chlorate, and sodium carboxymethylcellulose.

18. The gas generating composition of claim 14, consisting essentially of guanidine nitrate, basic copper nitrate, aluminum hydroxide having an average particle size of 11 μm, and sodium carboxymethylcellulose.

19. A gas generating composition comprising the following components (a), (b), and (c) and optionally the component (d) and/or the component (e):

(a) 10 to 60% by mass of an organic compound as fuel, (b) 10 to 85% by mass of an oxygen-containing oxidizing agent, (c) 0.1 to 20% by mass of aluminum hydroxide having an average particle size of 2 to 50 μm, (d) a binder, (e) an additive selected from metal oxides and metal carbides.

20. The gas generating composition as set forth in claim 1, comprising 20% by mass or less of the component (d) and 20% by mass or less of the component (e).

21. A molded article of a gas generating composition having a single-perforated cylindrical shape, a porous cylindrical shape or a pellet shape, the molded article being obtained from the gas generating composition as set forth in claim 19 or 20.

22. An airbag inflator, comprising:

the gas generating composition as set forth in claim 19.

23. An airbag inflator, comprising:

the molded article of a gas generating composition as set forth in claim 21.

24. A gas generating composition consisting essentially of the following components (a), (b), and (c) and optionally the component (d):

(a) 10 to 60% by mass of an organic compound as fuel selected from the group consisting of nitroguanidine, guanidine nitrate, and melamine, (b) 10 to 85% by mass of an oxygen-containing oxidizing agent selected from the group consisting of basic copper nitrate, strontium nitrate, ammonium perchlorate, potassium perchlorate, sodium perchlorate, sodium chlorate, and potassium chlorate, (c) 0.1 to 20% by mass of aluminum hydroxide having an average particle size of 2 to 50 μm, (d) 20% by mass or less of a binder selected from the group consisting of sodium carboxymethylcellulose and guar gum.

* * * * *